US011883717B2

(12) United States Patent
Claudio et al.

(10) Patent No.: US 11,883,717 B2
(45) Date of Patent: Jan. 30, 2024

(54) WEIGHTLIFTING MACHINE AND METHOD OF USE

(71) Applicants: Nicholas Claudio, Winter Garden, FL (US); Alexandre Ploumis, Winter Garden, FL (US)

(72) Inventors: Nicholas Claudio, Winter Garden, FL (US); Alexandre Ploumis, Winter Garden, FL (US)

(73) Assignee: Claudio Ploumis, Inc., Winter Park, FL (US)

( * ) Notice: Subject to any disclaimer, the term of this patent is extended or adjusted under 35 U.S.C. 154(b) by 128 days.

(21) Appl. No.: 17/153,600

(22) Filed: Jan. 20, 2021

(65) Prior Publication Data

US 2021/0220704 A1 Jul. 22, 2021

Related U.S. Application Data

(60) Provisional application No. 62/963,981, filed on Jan. 21, 2020.

(51) Int. Cl.
*A63B 24/00* (2006.01)
*A63B 21/062* (2006.01)
(Continued)

(52) U.S. Cl.
CPC ..... *A63B 24/0087* (2013.01); *A63B 21/0058* (2013.01); *A63B 21/00181* (2013.01);
(Continued)

(58) Field of Classification Search
CPC ..... A63B 24/0087; A63B 24/0062; A63B 24/0093; A63B 21/00181; A63B 21/0058; A63B 21/0059; A63B 21/0628; A63B 21/154; A63B 21/156; A63B 21/4035; A63B 21/06; A63B 21/062; A63B 21/0632; A63B 22/0002; A63B 71/0622;
(Continued)

(56) References Cited

U.S. PATENT DOCUMENTS 5,328,429 A * 7/1994 Potash ..... A63B 21/0058 482/99
9,409,053 B1 * 8/2016 Todd ..... G16H 20/30
(Continued)

*Primary Examiner* — Megan Anderson
*Assistant Examiner* — Sara K. Conway
(74) *Attorney, Agent, or Firm* — Jason T. Daniel, Esq.; Daniel Law Offices, P.A.

(57) ABSTRACT

A weightlifting machine includes a frame assembly having a plurality of pulleys that are connected to a user grip and plurality of weighted panels. A plurality of proximity sensors are positioned along the frame assembly and function to identify a specific number of weighed panels being lifted during an exercise routine. A location sensor is provided along the frame assembly and functions to identify the speed and distance at which the weighted panels move. A system controller is communicatively linked to each of the sensors, and a motor is connected to the cable and pulley assembly. The system controller includes functionality for selectively activating the motor to aid or resist the user in moving the weighted panels based upon the sensor information. The system controller further including a memory and communication unit for storing exercise information of the user.

18 Claims, 5 Drawing Sheets

(51) Int. Cl.
*A63B 21/00* (2006.01)
*A63B 21/005* (2006.01)

(52) U.S. Cl.
CPC ..... *A63B 21/0628* (2015.10); *A63B 21/154* (2013.01); *A63B 21/4035* (2015.10); *A63B 24/0062* (2013.01); *A63B 2024/0093* (2013.01); *A63B 2209/08* (2013.01); *A63B 2220/13* (2013.01); *A63B 2220/833* (2013.01); *A63B 2220/89* (2013.01)

(58) Field of Classification Search
CPC ..... A63B 2209/08; A63B 2220/805; A63B 2220/13; A63B 2220/833; A63B 2220/89; A63B 2225/50; A63B 2024/0093
See application file for complete search history.

(56) References Cited

U.S. PATENT DOCUMENTS

| | | | | |
|---|---|---|---|---|
| 10,456,614 | B1 * | 10/2019 | Dube | A63B 21/0724 |
| 2015/0126332 | A1 * | 5/2015 | Lannon | A63B 23/1254 482/8 |
| 2018/0099184 | A1 * | 4/2018 | Eder | A63B 21/154 |
| 2018/0345080 | A1 * | 12/2018 | Orfield | A61B 5/224 |
| 2019/0099633 | A1 * | 4/2019 | Orady | A63B 21/0058 |
| 2019/0344123 | A1 * | 11/2019 | Rubin | A63B 24/0087 |
| 2020/0047055 | A1 * | 2/2020 | Ward | A63B 24/0021 |
| 2020/0070001 | A1 * | 3/2020 | Malis | A63B 24/0062 |

* cited by examiner

WEIGHTLIFTING MACHINE AND METHOD OF USE

CROSS-REFERENCE TO RELATED APPLICATIONS

This application claims the benefit of U.S. Application Ser. No. 62/963,981 filed on Jan. 21, 2020, the contents of which are incorporated herein by reference.

TECHNICAL FIELD

The present invention relates generally to exercise equipment, and more particularly to a weightlifting machine.

BACKGROUND

The statements in this section merely provide background information related to the present disclosure and may not constitute prior art.

When performing strength training exercises, users typically lift heavy weights a small number of times or lift light weights a large number of times until they reach muscle exhaustion. When working with a trainer, it is not uncommon for the trainer to assist the user in the upstroke (e.g., concentric) or downstroke (e.g., eccentric) portion of a lift, in order to allow the user to experience more repetitions at the maximum resistance their body can currently perform, thus resulting in a better workout with superior results.

Unfortunately, when lifting weights alone using a machine, there is no way for a user to receive assistance in this manner. Indeed, when using known weightlifting machines, it is not possible to adjust the resistance of the machine on the fly, as users must stop their workout and manually adjust the entire amount of weight being lifted. Upon adjusting the weight, the user can then resume working out, but must start over from the at-rest position.

Accordingly, it would be beneficial to provide a weightlifting machine that can provide dynamic weight-adjustment assistance to a user throughout the concentric and eccentric portions of a lifting routine, so as to overcome the drawbacks described above.

SUMMARY OF THE INVENTION

The present invention is directed to a weightlifting machine and method of using the same. One embodiment of the present invention can include a weightlifting device having a frame assembly for supporting a plurality of pulleys that are connected to a user grip and plurality of weighted panels. A plurality of proximity sensors can be positioned along the frame assembly and can function to identify a specific number of weighed panels being lifted during an exercise routine. A location sensor can be provided along the frame assembly and can function to identify the speed and distance at which the weighted panels move.

In one embodiment, a system controller is communicatively linked to each of the sensors, and a motor is connected to the cable and pulley assembly. The system controller can include functionality for selectively activating the motor to aid or resist a user in moving the weighted panels based upon the sensor information. The system controller further including a memory and communication unit for storing exercise information of the user including weights lifted, motor assistance provided and other information.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
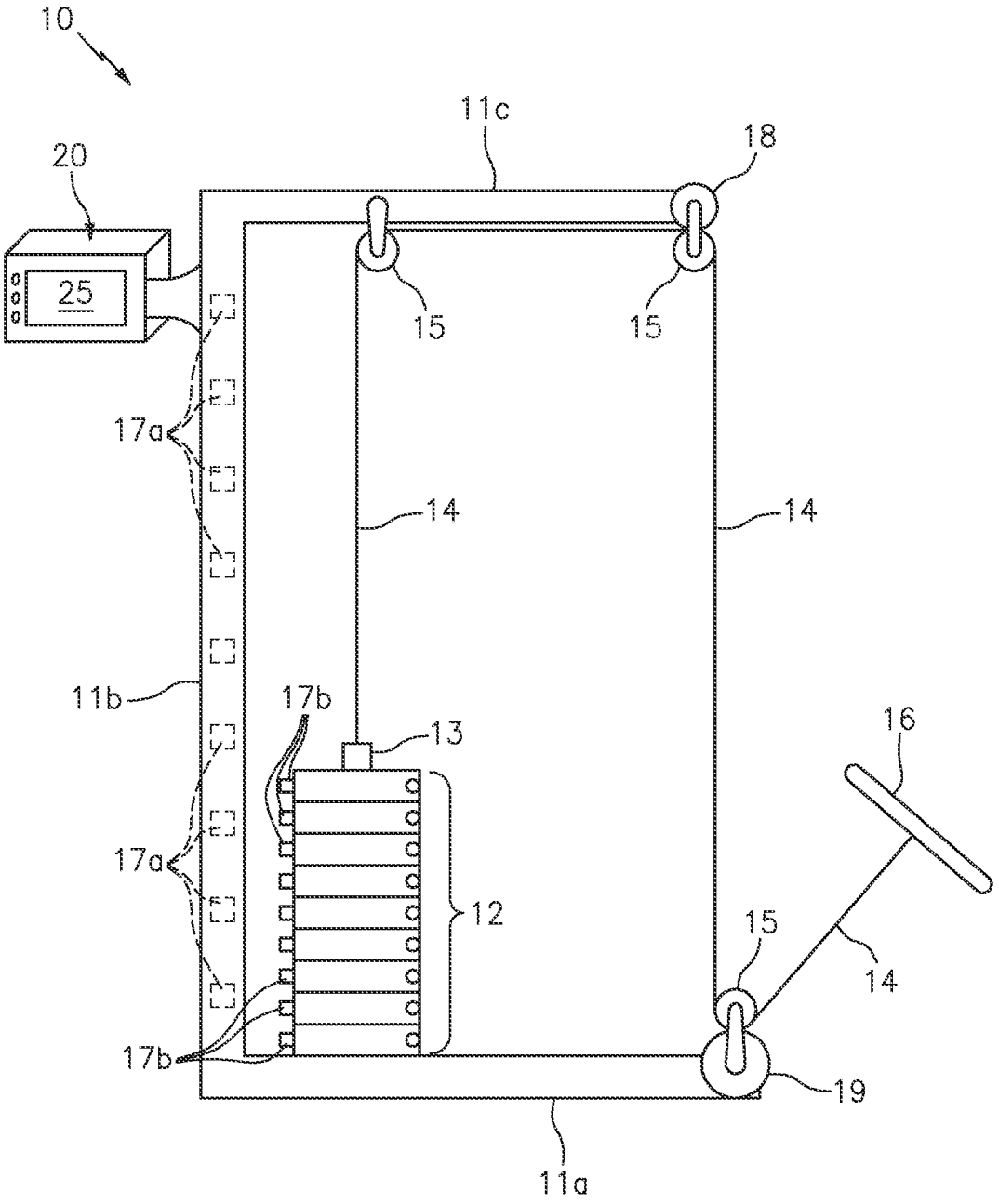
FIG. 1 is a perspective view of the weightlifting device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the terms "connector" and "complementary connector" include any number of different elements that work together to repeatedly join two items together in a nonpermanent manner. Several nonlimiting examples include opposing strips of hook and loop material (i.e. Velcro®), attractively-oriented magnetic elements, flexible strips of interlocking projections with a slider (i.e., zipper), tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

FIGS. 1-5 illustrate one embodiment of a weightlifting machine and associated method of use that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown at FIG. 1, one embodiment of the weightlifting device 10 can include a frame assembly having a bottom support member 11*a*, at least one vertical support member 11*b*, and a top support member 11*c*, for example. The frame assembly can include any number of different shapes and sizes and can be constructed from any number of sturdy materials such as steel, for example, that are able to support the weight and use of the system as hereinafter described.

In FIG. 1, the device 10 is shown in a generic configuration so as to easily convey the inventive concepts of the below described sensors and motor components. To this end, the device 10 can ultimately include any number of exercise specific components such as seats, benches, arm tables and the like for positioning a user to perform muscle specific exercises.

In one embodiment, a plurality of weighted plates 12 can be provided. Each of the plates 12 can be constructed from any number of different materials such as cast iron, for example, so as to comprise a known weight, and can include a physical marking denoting the same. In this regard, any number of different weighted plates can be provided so as to allow the machine to support any number of different weights.

Each of the weighted plates can be in communication with a selection rod 13 that is positioned along one end of an elongated cable 14. As is known in the art, the selection rod 13 can extend through the center of each of the weighted plates and can include a plurality of vertically aligned openings that can be engaged by a lock pin (not illustrated), for allowing a user to select and engage a particular number of weighted plates for each exercise routine.

The cable 14 can be in communication with any number of different pulleys 15 and can terminate onto a grip device 16 such as the illustrated hand bar, for example. The grip device functioning to allow a user to impart a pulling force onto the cable during an exercise routine, which results in a lifting of the selected number of weighted plates. Although illustrated with regard to a bar, this is for illustrative purposes only, as any number of different devices capable of being grasped by a user while operating the machine are also contemplated.

In one embodiment, a plurality of proximity sensors 17*a* can be provided along the vertical support 11*b*, and can function to detect sensor markers 17*b* located on each of the weighted plates as they are subsequently raised and lowered. In the preferred embodiment, each of the sensors 17*a* can comprise hall effect sensors and each of the sensor markers 17*b* can comprise magnetic elements. In this regard, each of the sensors can function to independently recognize and identify the marker for each weighted plate, and can report the location of the same to the below described controller 20. Such a feature providing the controller with a precise indication of how much weight is being lifted at any given time.

In one embodiment, a positional sensor 18 can be communicatively linked to one of the pulleys 15, and can function to detect and report the how far the weighted plates move along the allowable travel area. Such a sensor functioning to provide an indication of the overall distance which the user pulls the cord, thus indicating the completeness of each repetition attempted by the user during a lifting routine. One embodiment of a suitable positional sensor for use herein includes the KY-040 rotary encoder that is commercially available from Songhe industries. Of course, any number of other devices are also contemplated.

Although described above with regard to particular locations and/or types sensors, this is for illustrative purposes only, as any number of other locations and types of sensors and/or sensor markers are contemplated for use herein. Each of the sensors functioning to provide information with the system controller to allow the system to determine the amount of weight being lifted, the speed of each repetition, and the position of the weights at any given time throughout both the concentric and eccentric portion of a lifting routine.

In one embodiment, an electric motor 19 can be mechanically coupled to one of the pulleys 15 either directly, or via a belt-type arrangement, for example. In the preferred embodiment, the motor 19 can comprise a 24*v* DC motor that is capable of imparting variable amounts of rotational force onto the connected pulley in both a clockwise and counter-clockwise direction.

As will be described below, the motor can function to assist a user during the concentric portion of a lifting routine (e.g., when the user is lifting the weighted plates), and the eccentric portion of a lifting routine (e.g., when the user is lowering the weighted plates).

Figure 2:
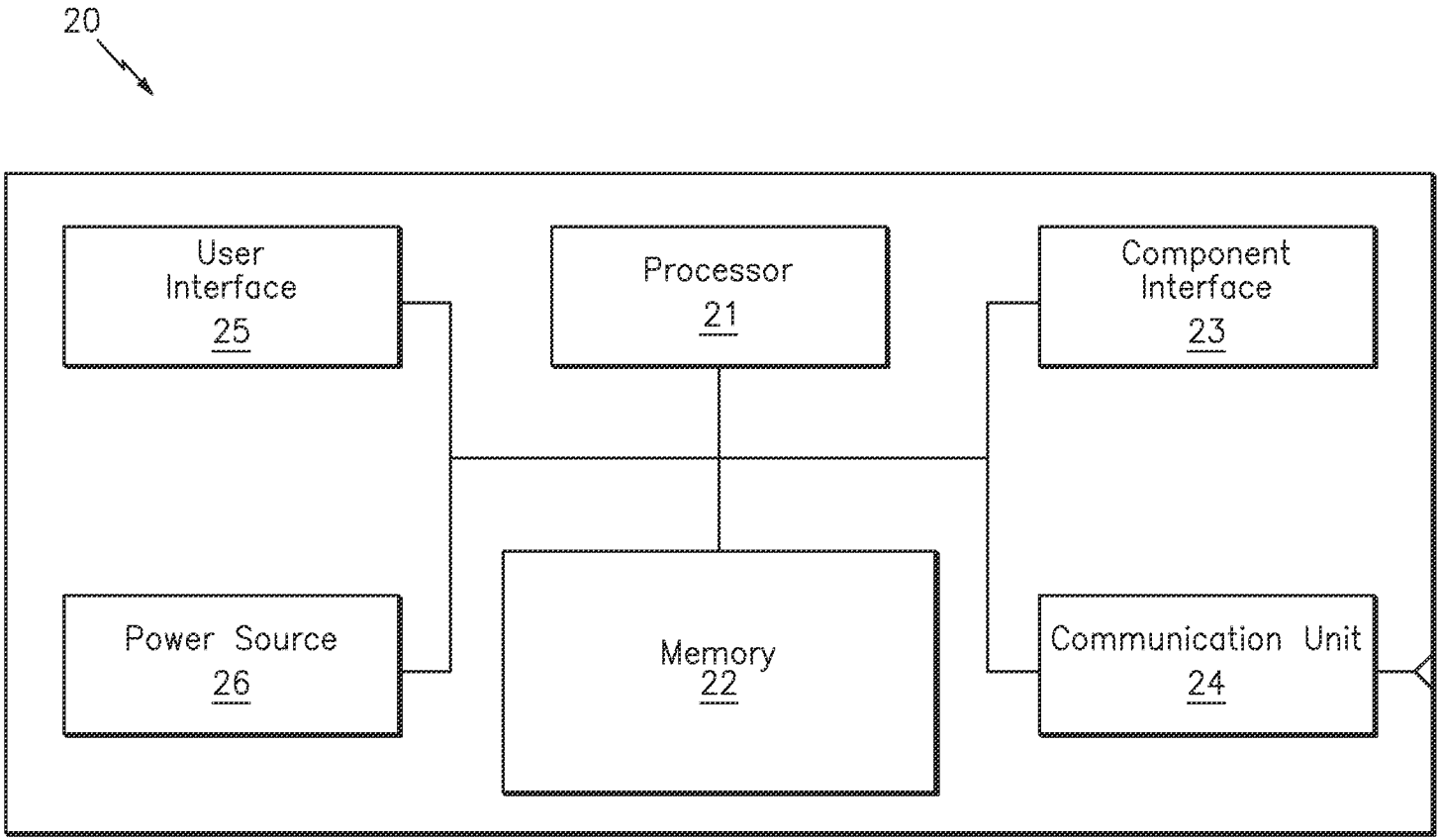
FIG. 2 is a simplified block diagram of the internal controller of the weightlifting device, in accordance with one embodiment of the invention.

FIG. 2 is a simplistic block diagram illustrating one embodiment of the system controller 20. As shown, the controller can include a processing unit 21 that is conventionally connected to an internal memory 22, a component interface unit 23, a wireless communication unit 24, a user interface 25, and/or a power unit 26.

Although illustrated as separate elements, those of skill in the art will recognize that one or more system components may comprise or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the described functionality can be provided in place of, or in conjunction with the described elements.

The processing unit 21 can include one or more central processing units (CPU) or any other type of device, or multiple devices, capable of manipulating or processing information such as program code stored in the memory 22 in order to allow the device to perform the functionality described herein.

Memory 22 can act to store operating instructions in the form of program code for the processing unit 21 to execute. Although illustrated in FIG. 2 as a single component, memory 22 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example. The bulk storage device can contain any number of different programs that permit the processor to perform the functionality described herein and can also receive and store the exercise information for each user.

The component interface unit 23 can function to provide a communicative link between the processing unit 21 and the system sensors 17*a*, the rotary encoder 18, and the motor 19. In this regard, the component interface unit can include any number of different components such as one or more PIC microcontrollers, standard bus, internal bus, connection cables, wireless receiver and/or associated hardware such as USB cables and connectors, and other such hardware capable of linking the various components. Of course, any other means for providing the two-way communication between the system components can also be utilized herein.

The communication unit 24 can include any number of components capable of sending and/or receiving electronic signals with another device, either directly or over a network. In various embodiments, the communication unit 24 can include a Bluetooth or WiFi transceiver which can communicate with a remote computing device such as a user smartphone, for example, that can be downloaded onto the user device and installed as an application. Such a feature can allow a user to monitor their workout progress and track metrics obtained by the machine. The system also allowing a user to store and retrieve previous exercises which can restore previously used system settings.

The user interface 25 can include or comprise any number of physical components capable of sending and/or receiving information with a user. In the illustrated embodiment, the user interface can include a touchscreen display having any number of graphical user interfaces (GUI) for interacting with a user and for allowing the user to selectively activate different programmatic functions as described below. Of course, any number of other types of displays and/or input mechanisms are also contemplated.

The power unit 26 can include any number of different components capable of providing the necessary power requirements to each element of the system. To this end, the power source can include or comprise any number of different batteries and/or can include a common A/C electrical power transformer and cord capable of allowing the system to be powered from an electrical outlet.

In operation, the device 10 can include functionality for monitoring the progress of a user's lifting routine and can selectively activate the motor 19 to lessen the resistance encountered and/or to impart additional resistance during the eccentric or concentric portion of a lifting repetition.

Figure 3:
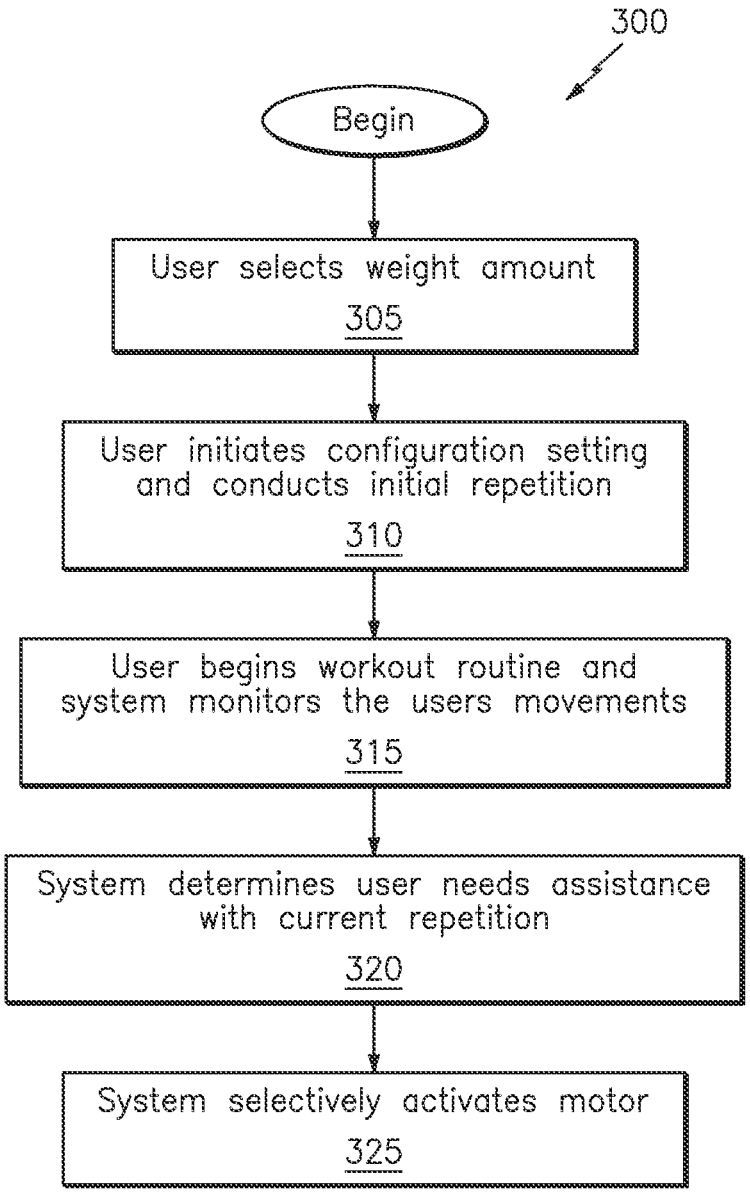
FIG. 3 is an exemplary and simplified method of using the weightlifting device.

To this end, FIG. 3 illustrates an exemplary method 300 for maximizing exercise routines utilizing the weightlifting machine described above. Prior to beginning the method steps, the user can access the display 25 to enter various details in order to retrieve any previous workout data and/or to configure the system to capture and store data generated by the present workout. Of course, many other user options will be available to the user, but are outside the scope of this document.

The method can begin at step 305 where the user can select a desired number of weighted plates to be used for the exercise by securing the lock pin into the selection rod in the conventional manner. At step 310, the user can access the display 25 to initiate a configuration setting and can then grasp the grip 16 and impart a pulling force onto the same for at least one, but preferably two repetitions.

While in the configuration setting, the sensors 17*a* can detect the amount of weight being lifted, and sensor 18 can detect and set the maximum travel distance (e.g., pull length) for the exercise which the user is currently performing.

Next, the method can proceed to step 315 where the user can begin their workout routine by repeatedly pulling and lowering the grip 16. During this time, the controller 20 can utilize the sensors 17*a* and 18 to monitor the user movements. More specifically, the system can monitor i) the direction the weight plates are traveling, thus indicating if the user is in the eccentric or concentric portion of a lift, ii) the speed with which the plates are traveling, and iii) the location along the travel distance where the weight plates are currently located. As the routine progresses, the system will continue to capture this data and can establish averages with relation to items i, ii and iii.

At step 320, the system can determine a change in the user routine (e.g., a delta) indicating the user may need assistance completing a repetition. When such an indication is noted, the system can use the sensor data to determine exactly where the user is in the current repetition and selectively activate the motor to provide assistance at step 325.

Figure 4:
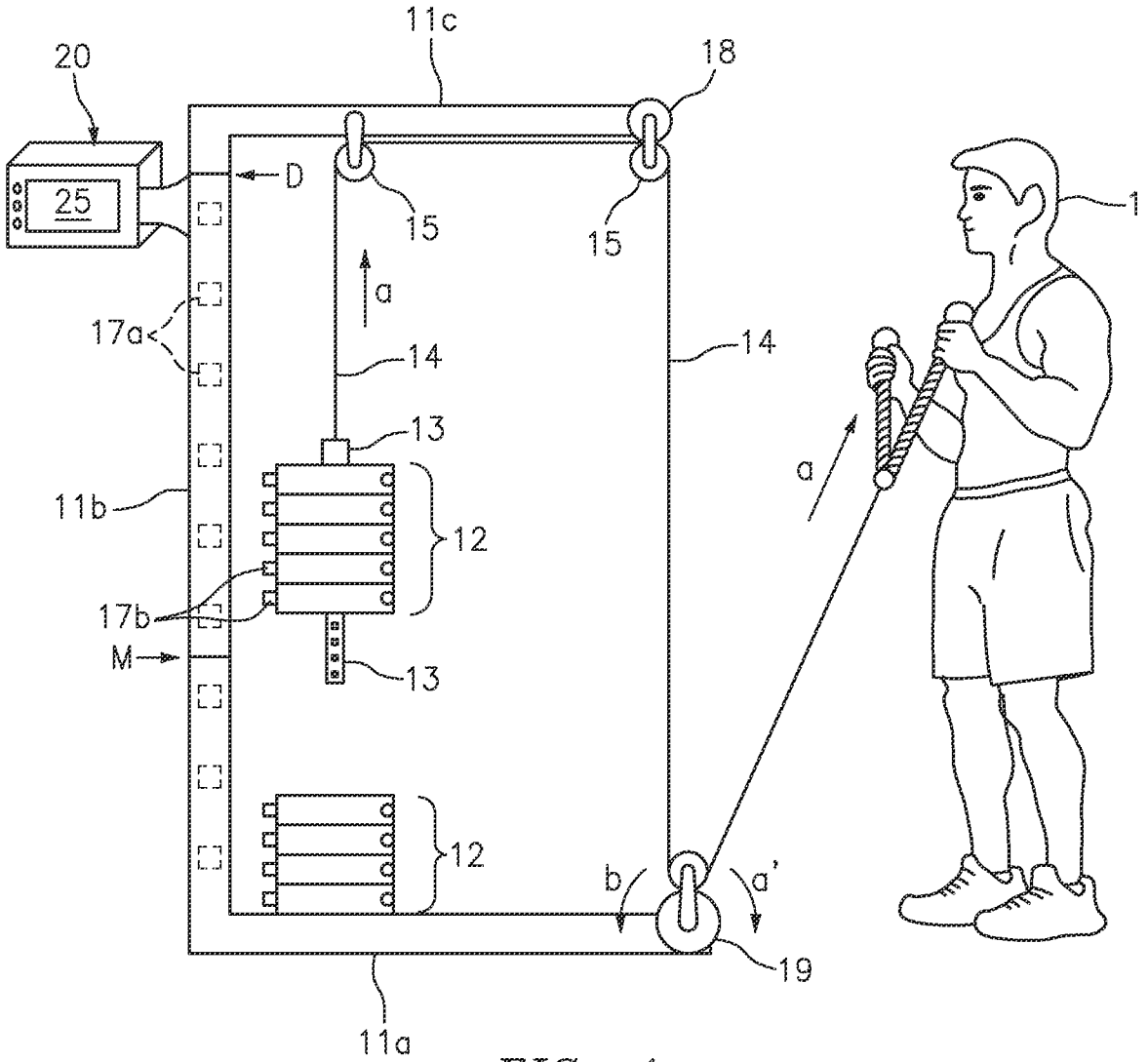
FIG. 4 is a perspective view of the weightlifting device in operation, in accordance with one embodiment of the invention.

For example, as shown at FIG. 4, when a user 1 is performing a concentric/pulling motion (arrow a), and the system detects that the speed of the weighted plates has slowed or stopped before reaching the maximum travel distance D, the controller 20 can activate the motor 19. In this example, the motor can be activated to incrementally apply pressure onto the pulley 15 in the direction of travel (arrow a'), thus lightening the amount of weight actually being lifted by the user. The incremental assistance by the motor can continue until the user is able to resume with the pulling motion and until the weight panels reach the maximum distance D established for this exercise. Such a feature allowing the system to provide a unique amount of assistance to the user in real time for every repetition of a lifting routine in order to enable the user to continue working out at maximum efficiency.

In another example, during the concentric/pulling motion by the user (arrow a), if the system detects that the speed of the weighted plates has increased beyond a predetermined threshold or set speed (e.g., greater than 5 miles per hour, for example), the controller 20 can activate the motor 19. In this example, the motor can be activated to incrementally apply pressure onto the cable in the direction opposite of travel (arrow b), so as to increase the amount of weight being lifted by the user. Such a feature ensuring that each repetition by the user is performed at a specific speed so as to maximize the effectiveness of the workout with regard to form, function and amount of weight being lifted.

Figure 5:
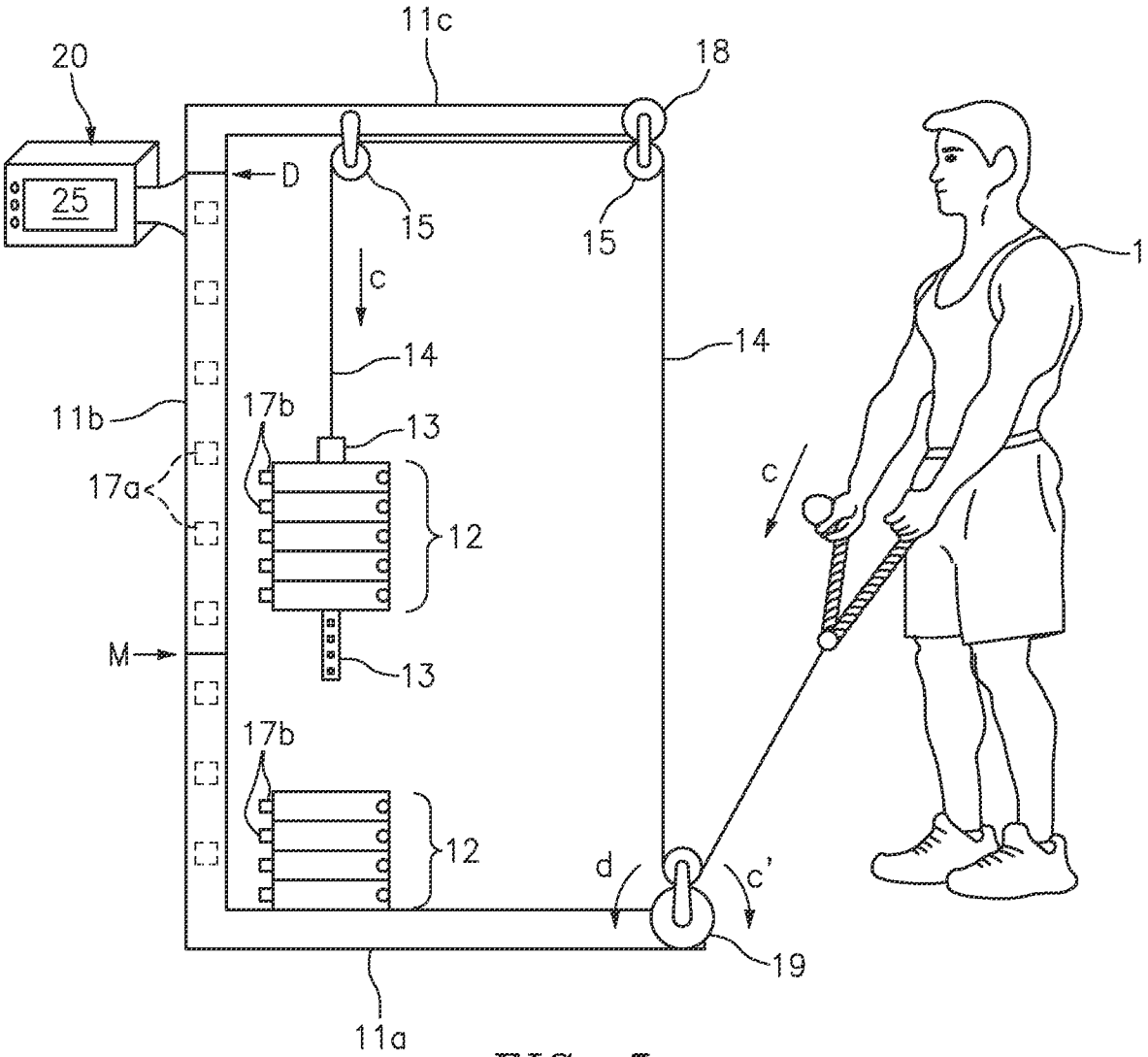
FIG. 5 is another perspective view of the weightlifting device in operation, in accordance with one embodiment of the invention.

In yet another example shown at FIG. 5, during the eccentric portion of a user routine shown at arrow c, if the system detects that the speed of the weighted plates has increased beyond a predetermined threshold or that the weights are in freefall, the controller 20 can activate the motor 19. In this example, the motor can be activated to incrementally apply pressure onto the cable in the direction opposite of travel (arrow c'), so as to function as a braking mechanism, thus lightening the amount of weight encountered by the user and slowing the movement of the plates.

In yet another example, during the eccentric portion of a user routine shown at arrow c, if the system detects that the speed of the weighted plates has slowed or stopped before reaching the minimum travel distance M, the controller 20 can activate the motor 19. In this example, the motor can be activated to incrementally apply pressure onto the pulley 15 in the direction of travel (arrow d), so as to increase the amount of weight being lifted by the user. Such a feature ensuring that each repetition by the user is performed at a specific speed so as to maximize the effectiveness of the workout with regard to form, function and amount of weight being lifted.

In various embodiments, the system can continue providing lift and/or braking assistance for the duration of each subsequent repetition in the set or can reset to a default (no assistance) setting until needed.

Accordingly, the above-described weightlifting machine and method of use provide dynamic weight-adjustment assistance to a user throughout the concentric and eccentric portions of a lifting routine, in a unique manner that is not rendered obvious by any known art.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A weightlifting device, comprising:

a frame assembly having a bottom support, a vertical support, and an upper support;

a plurality of pulleys that are disposed along the frame assembly;

an elongated cable that is in communication with each of the plurality of pulleys;

a plurality of weighted plates that are connected to a first end of the elongated cable;

a user grip that is connected to a second end of the elongated cable;

a plurality of proximity sensors that are disposed along the frame assembly;

a positional sensor that is connected to one of the plurality of pulleys; and a motor that is in communication with the elongated cable, wherein the user grip is configured to receive a force from a user to impart a movement of the plurality of weighted plates, and the proximity sensors and the positional sensor are configured to detect a speed and a distance the grip has been pulled, and wherein the motor is configured to selectively aid or resist said movement based on the detected speed of the grip movement.

2. The device of claim 1, wherein the plurality of proximity sensors are positioned along the vertical support of the frame assembly.

3. The device of claim 2, wherein the plurality of proximity sensors are each configured to detect a location of each of the plurality weighted plates.

4. The device of claim 2, wherein each of the plurality of proximity sensors comprises a hall sensor.

5. The device of claim 4, further comprising:

a plurality of magnetic markers, that are positioned along the plurality of weighted plates.

6. The device of claim 5, wherein each of the respective of hall sensors are configured to detect a location of each of the plurality of magnetic markers.

7. The device of claim 1, further comprising:

a system controller that is communicatively linked to the positional sensor, each of the plurality of proximity sensors, and the motor.

8. The device of claim 7, wherein the system controller includes functionality for receiving and storing information pertaining to a location of each of the plurality of weighted plates.

9. The device of claim 8, wherein the system controller includes functionality for activating the motor in a first direction to aid the movement of the plurality of weighted plates.

10. The device of claim 8, wherein the system controller includes functionality for activating the motor to resist the movement of the plurality of weighted plates.

11. A method, comprising: providing a weightlifting machine that includes a frame assembly, a plurality of pulleys that are disposed along the frame assembly, an elongated cable that is in communication with each of the plurality of pulleys, a plurality of weighted plates that are connected to a first end of the elongated cable, a user grip that is connected to a second end of the elongated cable, a plurality of proximity sensors that are disposed along the frame assembly, a positional sensor that is connected to one of the plurality of pulleys, a motor that is in communication with the elongated cable, and a system controller;

receiving, via the user grip, a pulling force in a first direction;

detecting, via the positional sensor and plurality of proximity sensors, a movement of the plurality of weighted plates in the first direction; and engaging the motor to impart one of a resistance to the pulling force in the first direction or an assistance to the pulling force in the first direction, wherein said engaging the motor is based on a detected speed of the movement of the plurality of weights in the first direction.

12. The method of claim 11, wherein selectively engaging the motor comprises:

engaging the motor to impart a force in the first direction.

13. The method of claim 11, wherein selectively engaging the motor comprises:

engaging the motor to resist a force in the first direction.

14. The method of claim 11, wherein the motor is configured to impart a resistance force to the first direction if the speed of the movement of the weighted plates is above a predetermined threshold.

15. The method of claim 14, wherein the motor is configured to impart an assistance force to the first direction if the speed of the movement of the weighted plates is below a second predetermined threshold.

16. The method of claim 15, further comprising:

receiving, via the user grip, a pulling force in a second direction;

detecting, via the positional sensor and plurality of proximity sensors, a movement of the plurality of weighted plates in the second direction;

engaging the motor to impart one of a resistance to the pulling force in the second direction or an assistance to the pulling force in the second direction, wherein said engaging the motor is based on a detected speed of the movement of the plurality of weights in the second direction.

17. The method of claim 16, wherein the motor is configured to impart a resistance force to the second direction if the speed of the movement of the weighted plates is above a third predetermined threshold.

18. The method of claim 17, wherein the motor is configured to impart an assistance force to the second direction if the speed of the movement of the weighted plates is below a fourth predetermined threshold.

* * * * *